US007011736B1

(12) United States Patent
Miller et al.

(10) Patent No.: US 7,011,736 B1
(45) Date of Patent: Mar. 14, 2006

(54) $U^{+4}$ GENERATION IN HTER

(75) Inventors: William E. Miller, Naperville, IL (US); Eddie C. Gay, Park Forest, IL (US); Zygmunt Tomczuk, Homer Glen, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 399 days.

(21) Appl. No.: 10/637,089

(22) Filed: Aug. 5, 2003

(51) Int. Cl.
*C25C 3/34* (2006.01)

(52) U.S. Cl. ..... 205/47

(58) Field of Classification Search ..... None
See application file for complete search history.

(56) References Cited

U.S. PATENT DOCUMENTS

| | | | | | |
|---|---|---|---|---|---|
| 3,922,231 | A | * | 11/1975 | Carlin et al. | 205/557 |
| 4,243,494 | A | * | 1/1981 | Riggs et al. | 205/46 |
| 4,588,485 | A | * | 5/1986 | Cohen et al. | 205/47 |
| 4,839,133 | A | * | 6/1989 | Vandegrift et al. | 205/47 |
| H857 | H | * | 12/1990 | Haas | 205/47 |
| 4,995,948 | A | * | 2/1991 | Poa et al. | 205/47 |
| 5,009,752 | A | | 4/1991 | Tomczuk et al. | |
| 5,164,050 | A | * | 11/1992 | Bertaud et al. | 205/47 |
| 5,443,705 | A | | 8/1995 | Miller et al. | |
| 5,531,868 | A | | 7/1996 | Miller et al. | |
| 5,650,053 | A | | 7/1997 | Gay et al. | |
| 6,365,019 | B1 | * | 4/2002 | Herrmann et al. | 205/47 |
| 6,911,134 | B1 | * | 6/2005 | Dees et al. | 205/43 |
| 2004/0134785 | A1 | * | 7/2004 | Gay et al. | 205/46 |

FOREIGN PATENT DOCUMENTS

JP 10-053888 A * 2/1998

OTHER PUBLICATIONS

K. Serrano et al., "Preparation of uranium by electrolysis in chloride melt", Journal of Nuclear Materials, vol. 282, pp. 137-145, Sep. 2000.*

* cited by examiner

*Primary Examiner*—Harry D. Wilkins, III
(74) *Attorney, Agent, or Firm*—Joy Alwan; Thomas G. Anderson; Paul A. Gottlieb

(57) ABSTRACT

A improved device and process for recycling spent nuclear fuels, in particular uranium metal, that facilitates the refinement and recovery of uranium metal from spent metallic nuclear fuels. The electrorefiner device comprises two anodes in predetermined spatial relation to a cathode. The anodese have separate current and voltage controls. A much higher voltage than normal for the electrorefining process is applied to the second anode, thereby facilitating oxidization of uranium (III), $U^{+}$, to uranium (IV), $U^{+4}$. The current path from the second anode to the cathode is physically shorter than the similar current path from the second anode to the spent nuclear fuel contained in a first anode shaped as a basket. The resulting $U^{+4}$ oxidizes and solubilizes rough uranium deposited on the surface of the cathode. A softer uranium metal surface is left on the cathode and is more readily removed by a scraper.

9 Claims, 3 Drawing Sheets

$U^{+4}$ GENERATION IN HTER

CONTRACTUAL ORIGIN OF INVENTION

The United States Government has rights in this invention pursuant to Contract No. W-31-109-ENG-38 between the U.S. Department of Energy and the University of Chicago, representing Argonne National Laboratory.

BACKGROUND OF THE INVENTION

1. Field of the Invention

This invention relates to a process to facilitate the removal of uranium during electrorefining, and, more specifically, this invention relates to a process for the generation of $U^{+4}$ in an electrochemical cell.

2. Background of the Invention

Current United States policy is to store unprocessed spent reactor fuel in a geologic repository. Long-term uncertainties are hampering the acceptability and eventual licensing of geologic repositories for spent nuclear fuel in the U.S., and driving up its cost. The resistance to plans for depositing radioactive material in the Yucca Mountain Repository is a case in point.

Instead of long term storage of untreated radioactive materials, preliminary treat-ment of spent nuclear fuel is being explored, including partial utilization of the fissile material contained in the spent fuel. Accordingly, there is an emphasis upon developing new technologies for reprocessing and reutilizing spent nuclear fuels.

A number of processes exist for the processing and recycling of nuclear fuels. These processes often involve aqueous solutions. Due to the presence of water, aqueous solutions are neutron moderators. This is because collisions between water nuclei and neutrons, which are initially created by the spontaneous fission of plutonium, lowers the neutrons' kinetic energies. This lower energy increases the likelihood of the neutrons inducing more fission upon their collision with the plutonium nuclei remaining in the fuel. Thus, previously innocuous levels of plutonium now become potential run-away fission hazards. This lowered critical mass necessitates the use of very low plutonium concentrations and redundant safeguards to assure fission control. Lower plutonium throughputs result. Aqueous solution processing and recycling of nuclear fuels is generally inefficient and not cost-effective.

Electrorefining is a metallurgical separation technique that has been used to recover uranium from fission products and other components of spent fuel from the Experimental Breeder Reactor-II (EBR-II) of the Idaho National Engineering and Environmental Laboratory (INEEL), which is associated with Argonne National Laboratory-West (ANL-W). Electrorefining also is used to purify impure plutonium metal. Separation by electrorefining is based on changes in oxidation state and is accomplished by the addition or removal of electrons at electrodes, rather than the use of chemical oxidizing or reducing agents (aqueous or otherwise), which can significantly increase the volume of waste generated.

Interest in recent years has focused on the large inventory of blanket fuel and other spent metal fuels at DOE sites. (Blanket fuel contains primarily uranium-238, a non-fissile isotope that a reactor converts to fissionable plutonium. The blanket fuel is encased in steel cladding and is situated beyond the reactor core's outer edge and thus forms a "blanket" around the core.) A current method used for the recovery of unfissioned uranium from blanket fuels is the high-throughput electrorefiner (HTER) design.

U.S. Pat. No. 5,650,053 awarded to Gay, et al. on Jul. 22, 1997 discloses an electrorefining device and process for the recovery of uranium from spent nuclear fuel. The device consists of a hollow cylindrical-shaped cathode encased by rings of outer and inner anodic dissolution baskets.

U.S. Pat. No. 5,531,868 awarded to Miller, et al. on Jul. 2, 1996 discloses a device and a process for the electrorefining of spent nuclear fuel. The device comprises a hollow cathode such that a portion of the anode is near the cathode.

U.S. Pat. No. 5,009,752 awarded to Tomczuk, et al. on Apr. 23, 1991 discloses a device and a process for the recovery of uranium and plutonium from spent metal clad fuel pins. The process uses secondary reactions between $U+^{4}$ cations and elemental uranium at the anode to increase reaction rates and improve anodic efficiency.

None of the aforementioned patents disclose an anodic device or method for the refinement and collection of uranium metal from spent nuclear fuels that facilitates the removal of uranium metal electrodeposited at the cathode without disruption of the normal electrorefining process.

A need exists in the art for a method and device for more efficient and more facile removal of uranium metal from the cathodes of electrorefiners. The method and device should not detract from the normal electrorefining process. Also, the method and device should not rely on the configuration, size or even the presence of the anode baskets in an electrorefiner.

SUMMARY OF INVENTION

An object of the present invention is to provide a process of efficiently processing and recycling spent nuclear fuels that overcomes many of the disadvantages of the prior art.

Another object of the present invention is to provide a method to maximize recovery of metal values from spent nuclear fuel in electrorefiners. A feature of the invention is that two anodic surfaces are utilized to produce ionized uranium, one anodic surface situated closer to the cathode than to the other anodic surface. An advantage is that the closer anodic surface produces an ionic species of uranium which facilitates removal of intractable deposited uranium on the cathode.

Still another object of the present invention is to provide a method for recovering uranium during normal electrorefining production sequences. A feature of the invention is the existence of a primary anode operating at a first voltage which does not generate significant amounts of $U^{+4}$, and a secondary anode operating at a second voltage which promotes the production of $U^{+4}$. An advantage of the invention is that the $U^{+4}$ produced at the secondary anode is positioned in close proximity to the dendritic uranium so as to ionize and otherwise solubilize the dendritic uranium. This $U^{+4}$ is thus used in situ and simultaneously with the electrorefining process to remove dendritic uranium deposited on the cathode.

Still another object of the present invention is to provide a method that allows for more facile recovery of uranium metal during electrochemical refining. A feature of the invention is that it obviates the need for the bulky mechanical scrapers heretofore necessary to remove hard layers of uranium metal deposited on the cathodes. An advantage of the invention is that less rigorous scraper technology and therefore less expensive componentry) is required to separate uranium metal from cathodes.

Yet another object of the invention is to provide an improved method for the electrochemical separation of uranium from spent nuclear fuel. A feature of the invention is that applied voltages are held at values such that residual fission products, e.g., noble metals, remain in the fuel confined in anode baskets. An advantage of the invention is that high-purity uranium is produced without trace quantities of other fission products.

Still another object of the invention is to provide a method for the removal of rough uranium deposited at a cathode that does not detract from the normal electrorefining process. A feature of the invention is an independent bus bar, positioned between anode baskets of an electrorefiner, acts as an independent anode for the production of $U^{+4}$ which is immediately used to remove the rough uranium. An advantage of this feature is that the method operates simultaneously with the normal electrorefining mode of the electrorefiner (i.e., without the need for reversal of applied voltage). Accordingly, no productive electrorefining time is lost.

Briefly, the invention provides a process for removing uranium from nuclear fuel contained in an electrorefiner, the process comprising oxidizing the uranium to create positively charged uranium ions; depositing the ions into a cathode as uranium metal; reoxidizing a portion of the deposited uranium metal so as to cause the reoxidiz-ed portion to separate from the cathode; removing the uranium metal from the cathode; and redepositing the reoxidized portion onto the cathode as uranium metal.

The invention also provides an improved electrorefiner cell, the improvement comprising a means for oxidizing $U^{+3}$ to $U^{+4}$.

BRIEF DESCRIPTION OF DRAWING

The invention together with the above and other objects and advantages will be best understood from the following detailed description of the preferred embodiment of the invention shown in the accompanying drawing, wherein.

DETAILED DESCRIPTION OF THE INVENTION

The instant invention provides a device and process for the recovery of materials residing together in a substrate. In particular, this invention provides an improved device and an improved process for processing spent nuclear fuel. The device and process provide for a more facile recovery of uranium metal to the extent that less use is required of bulky scrapers to remove crystalline uranium metal deposited at the cathode of an electrorefiner. The device and process facilitates recovery of uranium metal deposited at an electrorefiner's cathode without disruption of the normal electrorefining process, i.e., without shutting down or reversing applied voltages.

Thus, the instant invention is suitable for the improved isolation and extraction of metal from spent nuclear fuels. In this scenario, a supply of spent nuclear fuel serves as the reactive substrate. When the metal desired to be recovered is uranium, an exemplary feedstock is blanket fuel, which is depleted uranium contained in a stainless-steel cladding. Zirconium is contained in other metallic nuclear fuels.

Figure 1:
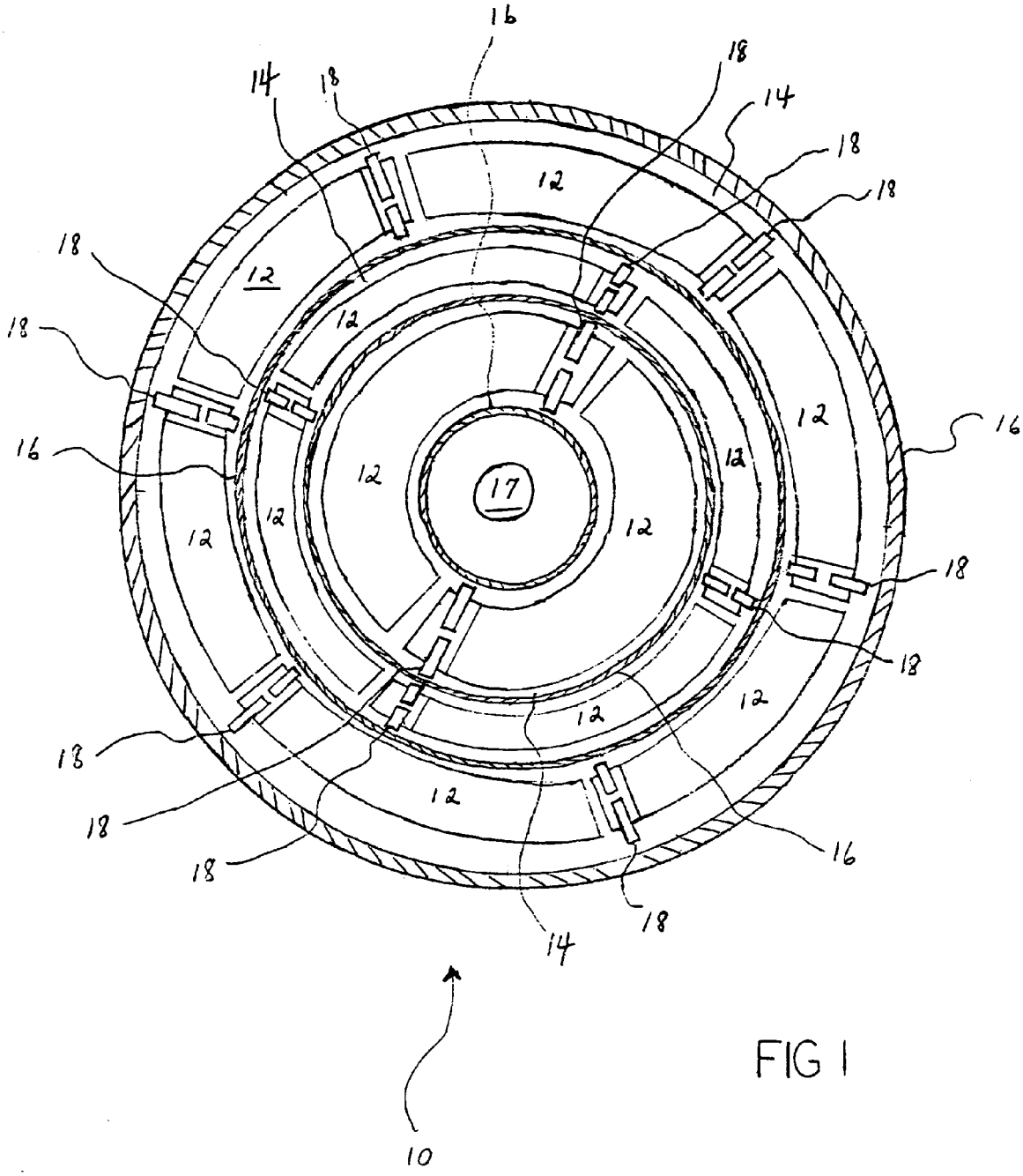
FIG. 1 is a cross-sectional view of a typical high throughput electrorefiner (HTER)

FIG. 1 depicts a cross-sectional view of an HTER designated as numeral 10. In the HTER 10, uranium is loaded into a plurality of anode baskets (all of the same size) 12, made of ferrous metals. The baskets 12 are rotationally and radially displaced in three channels 14 so as to be concentrically arranged to each other. Disposed about each ring of anode baskets 12 are stationary, cylindrically-shaped cathodes 16. A cathode tube is also concentrically disposed within the inner-most anode basket ring 12. The anode basket assembly is attached to a central spindle 17. The anode baskets 12 and the cathode tubes 16 are submersed in a molten LiCI-KCI eutectic (not shown). The molten eutectic also contains as much as 2 to 3 mol. % uranium as uranium (III) $U^{3+}$ cations, generally in the form of $UCI_3$. Uranium and the elements in the fuel that are less noble than uranium are oxidized ($U^0$ to $U^{+3}$) at the anode baskets 12 and form cationic species that dissolve in the molten salt. Zirconium (Zr) and noble metal fission products, such as molybdenum (Mo), ruthenium (Ru), palladium (Pd), platinum (Pt), and rhodium (Rh), remain in the anode baskets 12.

Uranium is transported from the anode baskets 12 (via electrostatic attraction) and deposited as uranium metal in a uniform cylindrical shape onto the negatively charged cathode cylinders 16 by rotating or otherwise passing the anode baskets by the cathodes. Uranium deposits on the cathodes to a thickness of about 0.125 inches. Scrapers 18 located on each anode basket 12, abrade and remove the electrodeposited uranium on the surfaces of the cathode cylinders 16. The purified uranium subsequently falls in a collection basket (not shown) attached to the bottom of the outer cathode tube 16.

Some of the uranium deposited is in the form of very rough dendrite (tree-like) crystals. One key step in the operating profile has been a periodic reversal of the current to remove the uranium that is not removed by the scrapers 18. This results in additional costs and time required for the electrorefining.

One manner of reducing the scraper inefficiencies is to send a cloud of uranium (IV) ($U^{+4}$) ions towards the uranium-coated cathode 16, and allow the $U^{4+}$ ions to react with outer layers of the deposited uranium on the cathode surface 16 to produce $U^{3+}$ ions. This removal of the outer layer of uranium on the cathode 16 would expose the softer, underlying uranium metal which scrapers 18 can dislodge more readily. The newly formed $U^{3+}$ ions are then again reduced to uranium metal at the cathode 16.

Anodes can be used to produce $UCI_4$, and thus $U^{+4}$ ions in situ, during the normal electrorefining process. However, very little $UCI_4$ is in fact produced inasmuch as this cycle is limited to an impressed voltage of −0.4 to −0.5 V. If the anodes are used after the normal dissolution cycle (i.e., after removal of the uranium/plutonium from the spent nuclear fuels contained in the anode baskets 12), the impressed voltage is still limited to −0.4 to −0.5 V. Otherwise, at higher absolute voltages, the zirconium and noble metal fission products remaining in the anode baskets 12 would be ionized and transferred to the cathode 16 for reduction.

If empty anode baskets 12 are used for $U^{+4}$ production, the applied voltage can be raised to a value as high as −0.9 V (above that voltage and the ferrous metal baskets 12 are subject to electrochemical corrosion). In this scheme, however, the overall processing rate for the electrorefiner is greatly diminished since anodic dissolution space and time are being consumed in a recovery mode, not a productive dissolution mode.

A salient feature of the invention is a plurality of bus bars which are physically part of a rotating primary anode drive in an HTER, but are electrically isolated (insulated) from it. These bus bars have electrical and voltage controls which are separate from the primary anodes where the spend fuel feedstock resides. Each bus acts as a separate and second anode, and is placed closer to the cathode than to the primary anodes.

A preferred embodiment is a bus bar positioned between each two adjacent anode baskets. In this preferred embodiment, the number of bus bars is equal to the number of anode baskets. This feature, plus the greater physical proximity of the bus bar-produced $U^{+4}$ to the cathode (compared to the distance for $U^{+4}$ to migrate to the uranium in the primary anode baskets), allows each bus bar to remove "rough" uranium which was deposited on the cathode surface by cathodic reduction of $U^{+3}$.

Each bus bar anode produces $U^{+4}$ which chemically reacts with uranium ($U^0$) on the cathode surface to produce $U^{+3}$. This chemical reaction ionizes (and therefore solubilizes) the rough, crusty uranium metal which tends to deposit at/on the cathode, and leaves behind softer uranium which is easier for a scraper to remove.

Thus, the uranium (IV) $U^{+4}$ generated from each independent bus can be more effective in removing uranium deposits from the cathode than the $U^{+4}$ generated in the anode baskets (the first or primary anodes) containing uranium metal. This is because the bus bars (secondary anodes) are operated at higher voltages than the voltages at which the primary anodes operate-the higher voltages produce more $U^{+4}$.

In summary, the relatively closer proximity of the bus bars to the cathodes, and the greater distance of the bus bars from the primary anodes, accomplishes two things.

1. The close proximity encourages $U^{+4}$ migration to the cathode;
2. Simultaneous to this migration, the relative remote positioning of the secondary anode to the primary anode discourages unwanted oxidation reactions from occurring in the anode baskets, and therefore unwanted carry-over of other metals contained in the fuel feedstock contained in those baskets.

In light of the foregoing, an enabling feature of the instant invention is that each bus bar operates independently of the normal electrorefining mode of the electrorefiner. Further, the bus bars can be in operation at all times during the electrorefining process.

Thus, the electrorefiner cell with the instant invention comprises a means for establishing a first voltage between the cathode and the first anode, and further comprises a means for establishing a second voltage between the cathode and the second anode.

Equations 1 through 5 depict the primary anodic, secondary anodic (bus bar), chemical, primary cathodic, and secondary cathodic reactions which occur within the HTER electrorefiner cell.

$$U^0 \rightarrow U^{+3} + 3e^- \qquad \text{Equation 1 (Primary Anodic)}$$

$$4U^{+3} \rightarrow 4\,U^{+4} + 4e^- \qquad \text{Equation 2 (Secondary Anodic)}$$

Equation 3 (Chemical)

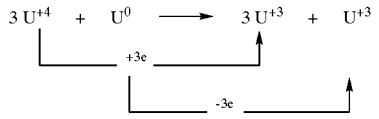

$$U^{+3} + 3e^- \rightarrow U^0 \qquad \text{Equation 4 (Primary Cathodic)}$$

$$U^{+4} + 4e^- \rightarrow U^0 \qquad \text{Equation 5 (Secondary Cathodic)}$$

Equation 1 represents the primary oxidation, at the primary anode, of metallic uranium contained in spent blanket fuel and spent metallic nuclear fuel rods. Equation 4 represents the primary reduction of uranium (III), $U^{+3}$, to uranium metal, $U^0$, at the cathode. The reactions given in Equations 2, 3, and 5 contribute to $U^{+4}$ generation and destruction. The first reaction (primary anodic) produces one $U^{+3}$ ion from one $U^0$ atom and contributes three electrons to the circuit. The second reaction (secondary anodic/bus bar) produces 4 $U^{+4}$ ions from 4 $U^{+3}$ ions and contributes 4 electrons to the circuit. The third reaction (electrochemical) consumes 3 ions ($U^{+4}$) and is balanced electronically internally (contributes no electrons to the circuit) because it is a chemical reaction. The fourth reaction (primary cathodic) consumes 1 ion ($U^{+3}$), provides 1 atom ($U^0$) and draws three electrons from the circuit. The fifth reaction (secondary cathodic) consumes 1 ion ($U^{+4}$), provides 1 atom ($U^0$) and draws 4 electrons from the circuit.

The overall electrochemical reaction for the production of $U^{+4}$ in the cell is given by Equation 6 (which combines Equations 2 and 5):

$$4U^{+3} + 12Cl^- = 3UCl_4 + U^0 \qquad \text{Equation 6}$$

Rough uranium crystals deposited on the cathode surface are thus dissolved to $U^{+3}$, and these resulting uranium (III) ions are subsequently re-reduced to uranium metal, $U^0$, again at the cathode. Some residual uranium (IV), $U^{+4}$, is also reduced directly to uranium metal at the cathode.

The voltage present in the bus bar is selected and maintained at a level sufficient to cause oxidation of $U^{+3}$ ions which are in close proximity to the bus surface to $U^{+4}$. (Other positive ions in the electrolyte or noble metals in the anode are not affected.) This allows for subsequent reduction of the targeted metal ion moiety (i.e., $U^{+4}$ to $U^{+3}$). A reasonable level of purity is thus attained in the electrorefinement of the uranium. Thus, the instant invention extracts elemental metal(s) from spent nuclear fuel substrate.

The invention exploits the phenomenon that the more negative the potential ($E_0$) of a reaction, the less spontaneous the reaction. Specifically, a voltage or decomposition voltage (−0.8 V) of the cell is less negative (a lower absolute value) than a voltage of (−1.6). The negative values associated with the above example should be construed as applied or impressed voltage. Applied voltages can be controlled at a level so as to not oxidize other metals present in, for example, the electrorefiner. An example of the non-oxidation of other metals present in the electrorefiner is that of iron (Fe), a material of construction for anode components.

The fused salt electrolyte carries a low concentration of $UCl_3$ (1 to 3 mol %).

As the anode voltage is increased, iron in the anode causes some displacement of $UCl_3$ by forming iron (II) chloride ($FeCl_2$) in the electrolyte by the corrosion of anodic structural materials. If the cell voltage (primary anode/cathode voltage) is limited to approximately −0.8 to −0.9 V, the iron concentration in the electrolyte is limited to ≦5 parts per million (ppm), and anodic ferric materials are kept in the metallic state.

If the secondary anode's structure comprises molybdenum instead of iron, the equilibrium concentration of molybdenum in the fused salt is approximately 50 parts per billion (ppb) at an applied cell voltage of −1.4 V.

Since a higher voltage is required to produce large concentrations of $U^{+4}$ in the electrolyte, the bus bars can be made of a metal selected from the group consisting of molybdenum-tungsten alloy (70 wt. % Mo and 30 wt. % W), molybdenum, and tungsten. This allows each bus bar to be small and carry a relatively high voltage. A preferred embodiment is the molybdenum-tungsten alloy. (The addition of tungsten to molybdenum gives greater malleability and ductility.)

The scrapers are usually made of beryllia (beryllium oxide, BeO) and are not affected by the applied voltages of the instant invention. Beryllium's standard reduction potential ($Be^{+2}+2e^{-}Be^{0}$) is −1.97 V.

Device Detail

The device features a plurality of bus bars (also designated herein as secondary anodes) located between adjacent primary anodes 12, (also called anode baskets) in an electrorefiner cell. Exemplary primary anodes are formed of ferrous metal anode baskets, those baskets containing the chopped uranium fuel pins and any cladding associated therewith.

Figure 2:
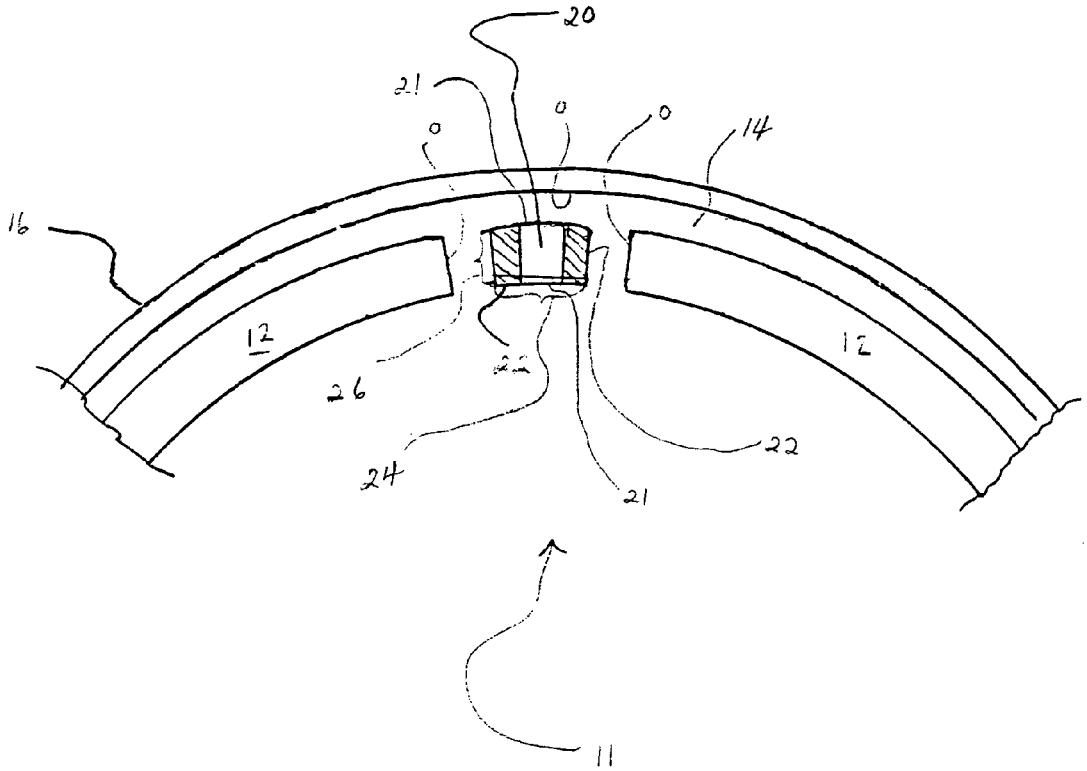
FIG. 2 is a schematic diagram of salient features of the device, in accordance with features of the present invention.

A schematic diagram of a cross-section of one portion of an electrorefiner cell containing a bus bar 20 is depicted in FIG. 2 as numeral 11. This device can be located in situ or off-site from the point where fissionable material is utilized. Each bus 20 is situated in a channel 14, which contains electrolyte, and is in close spatial relation to both the cathode 16 and the anode baskets 12. However, the current path from the bare faces 21 of the bus bar 20 to the cathode 16 is shorter than the current path to the uranium in the chopped fuel contained in the anode baskets 12. Insulators 22 are in physical contact with surfaces of the bus bar directly opposing surfaces (designated as "o") of the anode baskets 12. This insulator configuration assures general electrical insulation of each bus 20 from the anode baskets 12. As such, the bus bar 20 can actually be mechanically attached to the opposing surfaces of the primary anodes (so that no empty space exists between the two structures) as long as an insulator is positioned therebetween. For example, a rigid structure comprising alternating primary anode baskets, insulators, bus bars is envisioned, for the sake of fabrication and handling ease.

The size of the bus bars (secondary anodes) 20 can be independent of the size of the primary electrodes, i.e., the cathode 16 and the anode baskets 12. In a preferred embodiment, the vertical length of each bus 20 is the same as the vertical lengths of the electrodes. (It should be noted that the vertical lengths of the various substrates are not depicted in FIG. 2. Rather, these lengths extend perpendicular to the plane of the figure.) In one embodiment, the bus bar's circumferential width 24 can range from about one-half inch (½") to one inch (1"). The radial thickness 26 can range from about one inch (1") to 3 inches (3"). Each bus 20 functions as part of a secondary anode, which has separate electrical current and voltage controls. However, these measurements are to be determined empirically, depending on the desired throughput of the electrorefiner, voltage parameters, metals to be isolated, and other values.

Each bus bar 20 is attached to the rotating anode 12, but electrical insulators 22 prevent any direct electrical contact between the bus bars 20 and the rotating anode 12. Thus, each bus 20 moves in tandem with the primary anodes it is juxtaposed therebetween, while simultaneously electrically isolated from the primary anodes 12 and the cathode 16.

Figure 3:
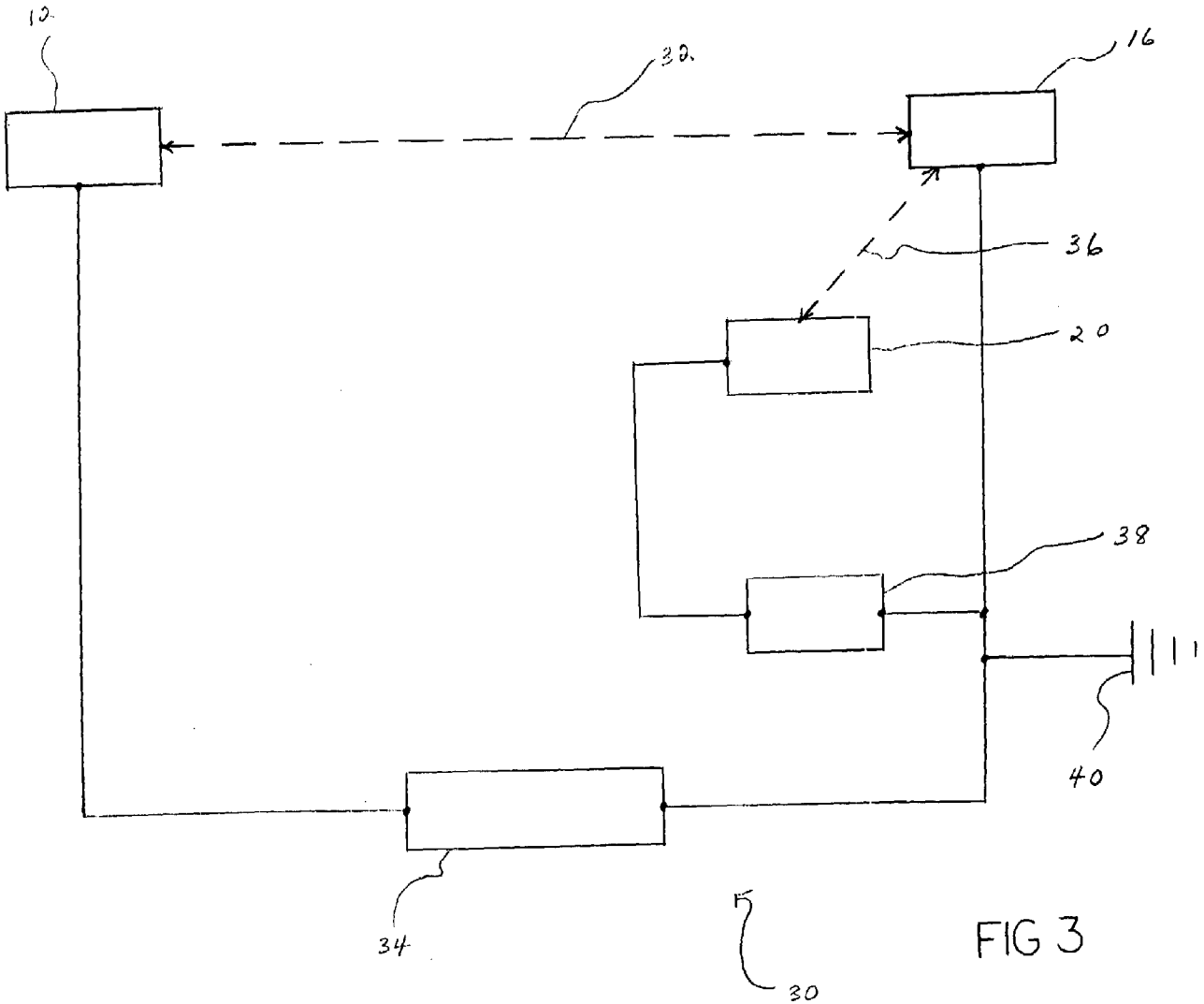
FIG. 3 is a schematic diagram of the general electrical circuit which comprises, in part, the invented device, in accordance with features of the present invention.

FIG. 3 is a schematic of the general electrical circuit 30 in which the device is located and details the circuit's activity with regard to uranium and the two different anodes. The first anode (anode baskets) 12 and the cathode 16 have a first voltage 32 between them and a first power supply 34 for their circuit. The second anode 20 (i.e., the bus) and the cathode 16 have a second voltage 36 between them. A second power supply 38 drives the second anode 20. The circuit is connected to an external ground 40. The first voltage 32 and the second voltage 36 are not the same.

The first anode 12, second anode 20, and the cathode 16 are immersed in the electrolyte salt bath (not shown), whereas the first power supply 34, the second power supply 38 and the external ground 40 are not.

The overall process is continual with electrical communication, by means of ionic transport, between each bus 20, the cathode 16, and the anode baskets 12. Further, the ionized metal is in electrical communication with the cathode 16, thereby leading to its reduction to elemental metal upon contact with the cathode 16.

The first applied or impressed voltage 32 ranges from about 0 to −0.45 V and the second applied or impressed voltage 36 from about 0 to −1.4 V. The limit of −0.45 V for the first voltage 32 is used to avoid the deposition of zirconium metal and noble metal fission products (such as ruthenium) contained in the spent metallic nuclear fuel, onto the cathode 16.

Accordingly, the production of $U^{+4}$ occurs when the second voltage potential is much higher (more negative) than the first voltage potential.

The absolute value of the first voltage potential is less than the absolute value of the second voltage potential.

The first voltage 32 and the second voltage 36 can each vary by ±20 millivolts (mV). The electrorefining process is carried out at a nominal operating temperature range of from between 500° C. and 690° C. with 500° C. being a preferred operating temperature.

Electrode Potentials and $U^{+4}$ Production

The standard cell potential ($E_0$) for the instant invention is given by the sum of the electrode potentials according to Equation 7:

$$E_0=E_1+E_2 \qquad \text{Equation 7}$$

where $E_1$ is the potential for the secondary anodic reaction given in Equation 2 supra, and $E_2$ is the potential for the secondary cathodic reaction given in Equation 5 supra.

The apparent potentials for these electrodes have been measured in the LiCl-KCl eutectic at 450° C., vs. a $Cl_2/2Cl^{-}$ reference electrode. These values give:

$$E_0=E_1+E_2=+1.47 \text{ Volts } (V)+(-2.27\ V)=-0.8\ V$$

The Nernst equation for the cell potential, (assuming that $a_u=1$; i.e., the uranium metal activity is equal to one) becomes, according to Equation 8:

$$E_{cell}=-0.8-0.01557 ln[a^3_{UCl4}a^4_{UCl3}] \qquad \text{Equation 8}$$

where "a" represents the activity of a particular moiety, and the exponents of 3 for $U^{+4}$ and 4 for $U^{+3}$ are those moieties' coefficients in Equation 6 supra, thus reflecting the reaction stoichiometry as given by Equation 6.

If $a_{UCl3}$ in the salt bath is constant at, for example, $a_{UCl3}$=0.02, then the salt ratio [$a_{UCl4}/a_{UCl3}$] created by the applied voltage can be estimated from the Nernst equation. A sample calculation is as follows: $a_{UCl4}/a_{UCl3}$=0.272 (from $7^{th}$ column in Table 1 infra). $a^3_{UCl4}/a^3_{UCl3}$=0.0201. 0.0201÷0.02=($a^3_{UCl4}/a^3_{UCl3}$)÷$a_{UCl3}$=$a^3_{UCl4}/a^4_{UCl3}$=1.00. Ln(1)=0. Thus, for $a_{UCl4}/a_{UCl3}$=0.272, the Nernst equation gives an applied voltage of −0.8 V. Or, an applied voltage of −0.8 V gives a value of 0.272 for the ratio of the activity of $UCl_4$ to the activity of $UCl_3$. Table 1 gives a tabulation of applied voltages and the resulting activity ratios of $U^{+4}$ to $U^{+3}$.

Table 1. Uranium chloride salt activity ratios as a function of applied voltage.

TABLE 1

Uranium chloride salt activity ratios as a function of applied voltage.

| E | 0 | −0.2 | −0.4 | −0.6 | −0.7 | −0.8 | −0.9 | −1.4 |
|---|---|---|---|---|---|---|---|---|
| $a_{UCl4}/a_{UCl3}$ | $9.9 \times 10^{-9}$ | $7.2 \times 10^{-7}$ | $5.2 \times 10^{-5}$ | 0.00376 | 0.0391 | 0.272 | 2.31 | 102,868 |

Assuming both moieties' ($UCl_4$ and $UCl_3$) activity coefficients to have values at or near one, the activity ratios can be read as being roughly equal to ratios of actual concentrations of $UCl_4$ to $UCl_3$. Further, these ratios of activities or concentrations can also be read as decimal fraction expressions of the measure of conversion of $UCl_3$ to $UCl_4$ at different applied voltages.

As can be seen in Table 1 supra, if the voltage is doubled, e.g., from −0.4 V to −0.8 V, the ratio of $UCl_4$ to $UCl_3$ is increased by a factor of about 5000. Increasing the voltage, i.e., a more negative applied voltage, thus increases the amount of $U^{+4}$ available to react with and thus remove rough uranium from the cathode surface. As the applied voltage approaches −0.8 V, the conversion of $UCl_3$ to $UCl_4$ could approach 25% in the vicinity of the secondary anode (bus bar) surface. Higher applied voltages, as can be seen from Table 1 supra, lead to even greater conversion of $UCl_3$ to $UCl_4$.

In summary, the instant invention provides an improved means for the electrorefinement of uranium metal from spent metallic nuclear fuels. The invention allows for a more facile recovery of uranium metal from the surface of the cathode of an electrorefiner thus alleviating, at least partially, the need for a scraper to remove uranium deposited at the cathode.

The invention consists of electrically independent bus bars placed between every two adjacent anode baskets in a spent nuclear fuel electrorefiner. The bus bars act as secondary anodes, and aid in the removal of rough crystalline uranium metal deposited at the cathode in an electrorefiner.

This invention also relates to an improved or enhanced electrochemical system which provides for multiple means of uranium metal oxidation. The process utilizes electrochemical separation based on the differences in metals' electrochemical properties, and a novel design for the separator/electrorefiner.

The more negative the applied or impressed voltage for each bus bar, the smaller each bus bar can be in terms of its width and thickness.

Under normal electrorefining conditions, the HTER cell voltage (primary anode with the cathode) is controlled to limit the transport of zirconium and other noble metal fission products as cations from the anode to the cathode so only uranium is processed and refined in the HTER.

Materials for the bus generating the $U^{+4}$ are more noble than steel, such as molybdenum (Mo), to resist anodic dissolution at the greater applied or impressed voltage.

The invention operates simultaneously with the normal electrorefining mode of the electrorefiner and, accordingly, no productive electrorefining time is lost.

While the invention has been described with reference to details of the illustrated embodiment, these details are not intended to limit the scope of the invention as defined in the appended claims.

The embodiment of the invention in which an exclusive property or privilege is claimed is defined as follows:

1. A process for removing uranium from nuclear fuel contained in an electrorefiner, the process comprising:

a) oxidizing the uranium to create positively charged uranium ions;

b) depositing the ions onto a cathode as uranium metal;

c) reoxidizing a portion of the deposited uranium metal so as to cause the reoxidized portion to separate from the cathode;

d) removing the uranium metal from the cathode; and e) redepositing the reoxidized portion onto the cathode as uranium metal.

2. The process as recited in claim 1 wherein the step of oxidizing the uranium further comprises contacting the nuclear fuel to a first charged anode.

3. The process as recited in claim 1 wherein the step of reoxidizing a portion of the deposited uranium metal further comprises subjecting the deposited uranium metal to $U^{+4}$.

4. The process as recited in claim 1 wherein the $U+^4$ is produced by contacting $U^{+3}$ to a second charged anode.

5. The process as recited in claim 4 wherein a first voltage potential exists between the cathode and the first charged anode and a second voltage potential exists between the cathode and the second charged anode.

6. The process as recited in claim 5 wherein the first voltage potential and the second voltage potential are different.

7. The process as recited in claim 5 wherein the absolute value of the first voltage potential is less than the absolute value of the second voltage potential.

8. The process as recited in claim 4 wherein the second anode is closer to the cathode than to the first anode.

9. The process as recited in claim 5 wherein the production of $U^{+4}$ occurs when the second voltage potential is higher than the first voltage potential.

* * * * *